US007004356B1

(12) United States Patent
Sayers

(10) Patent No.: US 7,004,356 B1
(45) Date of Patent: Feb. 28, 2006

(54) FOAM PRODUCING PUMP WITH ANTI-DRIP FEATURE

(75) Inventor: Richard C. Sayers, Akron, OH (US)

(73) Assignee: Joseph S. Kanfer, Richfield, OH (US)

( * ) Notice: Subject to any disclaimer, the term of this patent is extended or adjusted under 35 U.S.C. 154(b) by 205 days.

(21) Appl. No.: 10/628,126

(22) Filed: Jul. 28, 2003

(51) Int. Cl.
*B05B 9/043* (2006.01)

(52) U.S. Cl. ..... 222/137; 222/190; 222/145.2; 222/148; 222/321.9; 239/337

(58) Field of Classification Search ..... 222/137, 222/190, 145.2, 148, 321.1, 321.7, 321.9; 239/337, 343, 369, 419, 419.5, 428.5
See application file for complete search history.

(56) References Cited

U.S. PATENT DOCUMENTS 5,100,029 A * 3/1992 Meshberg ..... 222/321.9
5,110,052 A * 5/1992 Graf et al. ..... 239/337
5,147,087 A * 9/1992 Fuchs ..... 239/337
5,265,771 A * 11/1993 Meshberg ..... 222/321.9
5,348,189 A * 9/1994 Cater ..... 222/321.2
5,445,288 A 8/1995 Banks ..... 222/95
6,053,364 A 4/2000 van der Heijden ..... 222/145.6
6,082,586 A 7/2000 Banks ..... 222/95
6,220,483 B1 4/2001 van der Heijden ..... 222/136
2002/0070238 A1 6/2002 Pritchett et al. ..... 222/189.11

* cited by examiner

*Primary Examiner*—Eric Keasel
(74) *Attorney, Agent, or Firm*—Renner, Kenner, Greive, Bobak, Taylor & Weber

(57) ABSTRACT

A pump including a pump body having a head assembly slidably received therein; a mixing chamber in communication with an air source and a liquid source; wherein the head assembly is movable relative to the pump body to define a pump stroke, wherein the head assembly urges air from the air supply and liquid from the liquid supply into the mixing chamber to form a foam during the pump stroke; wherein the mixing chamber opens externally of the pump body and wherein during a portion of the stroke less than a complete stroke, the mixing chamber receives fluid and air to form a foam and discharge the foam externally of the pump and wherein during the remainder of the stroke, a blowing charge from the air source is urged through the mixing chamber and externally of the pump to evacuate any residual foam in the pump.

11 Claims, 6 Drawing Sheets

FOAM PRODUCING PUMP WITH ANTI-DRIP FEATURE

RELATED PATENT APPLICATIONS

None.

FIELD OF THE INVENTION

This invention relates, in general, to pumping devices and relates, in particular, to a pump capable of attachment to a container or reservoir, drawing material therefrom and converting a liquid material to a foam material by mixing it with air upon activation of the pump.

BACKGROUND OF THE INVENTION

It is well known to provide pumps which, when attached to a suitable reservoir of liquid, are capable, upon actuation of the pump, of expelling a foamed product from the outlet of the pump. Such pumps are well known and widely used to dispense a variety of products.

In general, they operate by attaching a pump to the neck of a container which serves as a reservoir for the liquid material which can take many forms, such as, soaps, lotions, etc. These pumps operate so that upon actuation of the pump a predetermined amount of liquid is drawn from the container or reservoir, mixed with air and expelled through a nozzle attached to one end of the pump. The mixing with air causes the material to be converted into a foam and such foam is then dispensed onto the hand of the user in the case of soap or lotion, for example.

Examples of patents dealing with pumps of this general type can be found in Banks U.S. Pat. No. 5,445,288; van der Heijden U.S. Pat. No. 6,053,364; Banks U.S. Pat. No. 6,082,586 and van der Heijden U.S. Pat. No. 6,220,483.

It has been found that these pumps are generally adequate for the purposes for which they were developed. The more conventional manner of distributing the material from the container is to set the container upright so that the pump extends upwardly from the container. However, it is often the case that a residue of foam remains on the nozzle and ultimately drips off. In the event there is a dripping problem, fairly complex valving arrangements have been utilized at the outlet or nozzle end of the pump or the pump has been designed so as to create a "suck-back" feature which pulls the residue back into the nozzle. Such modifications, however, add to development and pump costs.

This problem is particularly acute when the container is inverted and the pumping action takes place from beneath the container. This is a common practice wherein a replaceable container or reservoir is inverted and mounted in a dispenser which, in many instances, is mounted on a wall or other vertical surface with the nozzle and the pump itself projecting downwardly.

In any event, when a foam producing pump is operated in this fashion the pump, after exhausting its normal liquid pumping or drawing function, does not fully exhaust the foam stream particularly at the outlet or nozzle of the pump so that some of the foam stream typically hangs on the outlet at the end of the stroke and eventually, of course, will revert to its liquid form and drip. Dripping in pumps of this general nature and in pumps of this particular nature as well are objectionable because they are messy, unsightly and require maintenance to clean them up.

Accordingly, production of a foam producing pump of the type above-described which has an anti-drip feature becomes one object of this invention.

SUMMARY OF THE INVENTION

The current invention employs a typical foam producing pump and adds an additional feature intended to dislodge the foam stream from the outlet so as to eliminating dripping.

It has been found that this object can be achieved by providing a pump which has an extended air producing stroke. Typically pumps of this nature move liquid and air at the same time into a mixing chamber to create the foam in the chamber which is then expelled through the nozzle. This mixing is created during the stoke where both the liquid and the air are being expelled from the pumping apparatus.

In furtherance of the principal object of this invention, it has been found that if the air pump is still moving when the liquid pump bottoms out, the foam is pushed out of the orifice by the air during the remainder of the stroke and is broken off from the orifice tip by a blast of air thereby eliminating the hanging foam on the outlet or nozzle and ultimately eliminating dripping.

It is accordingly a principal object of this invention to produce a foam producing pump with an anti-dripping feature of the character above-described with other objects thereof becoming more apparent upon a reading of the following specification considered and interpreted in view of the accompanying drawings. In view of at least one of the objects of the present invention, a pump used in connection with a container filled with a liquid is provided. The pump includes a pump body defining an air chamber and a liquid chamber separated by a seal; a cup slidably received within the pump body at the liquid chamber, the cup being in selective communication with the liquid, whereby the cup is filled with liquid when the pump is in an idle position; a head assembly slidably mounted within the pump body and sealingly engaging the air chamber; a plunger extending from the head assembly through the seal and into the cup and slidably received therein; and a mixing chamber in selective fluid communication with the liquid chamber and the air chamber, the mixing chamber opening externally of the head assembly, whereby operation of the pump causes liquid from the liquid chamber and air from the air chamber to mix in the mixing chamber to form a foam which is discharged from the head assembly; wherein the cup is spaced from an end of the pump body by a first spring adapted to urge the cup toward the plunger; wherein the plunger is adapted to bottom out in the cup to empty the liquid chamber; wherein the air chamber is sized to allow further inward movement of the head assembly after the plunger bottoms out, whereby the further inward movement of the head assembly compresses the spring and forces a blowing charge from the air chamber through the mixing chamber and the head assembly to evacuate any foam remaining therein.

The present invention further provides a pump including: a pump body having a head assembly slidably received therein; a mixing chamber in communication with an air source and a liquid source; wherein the head assembly is movable relative to the pump body to define a pump stroke, wherein the head assembly urges air from the air supply and liquid from the liquid supply into the mixing chamber to form a foam during the pump stroke; wherein the mixing chamber opens externally of the pump body and wherein during a portion of the stroke less than a complete stroke, the mixing chamber receives fluid and air to form a foam and discharge the foam externally of the pump and wherein during the remainder of the stroke, a blowing charge from the air source is urged through the mixing chamber and externally of the pump to evacuate any residual foam in the pump.

The present invention further provides a method of dispensing foam including in a single stroke, pumping foam during a first portion of the stroke and pumping air during the remainder of the stroke.

The present invention further provides a dispenser including: a container having a pump mounted thereon; wherein the container is filled with a liquid; wherein the pump includes a pump body defining an air chamber and a liquid chamber and a head assembly movable relative to the pump body and adapted to mix air from the air chamber and liquid from the liquid chamber to form a foam that is discharged during a portion of a single pump stroke; wherein the liquid chamber is in selective fluid communication with the container; wherein the liquid chamber has a height less than that of the air chamber such that the head assembly evacuates the liquid chamber prior to evacuating all of the air in the air chamber, whereby completion of the pump stroke pumps the remaining air from the air chamber without mixing that air with the liquid, whereby any foam residue is urged outwardly by the air.

BRIEF DESCRIPTION OF THE PREFERRED EMBODIMENTS

Figure 1:
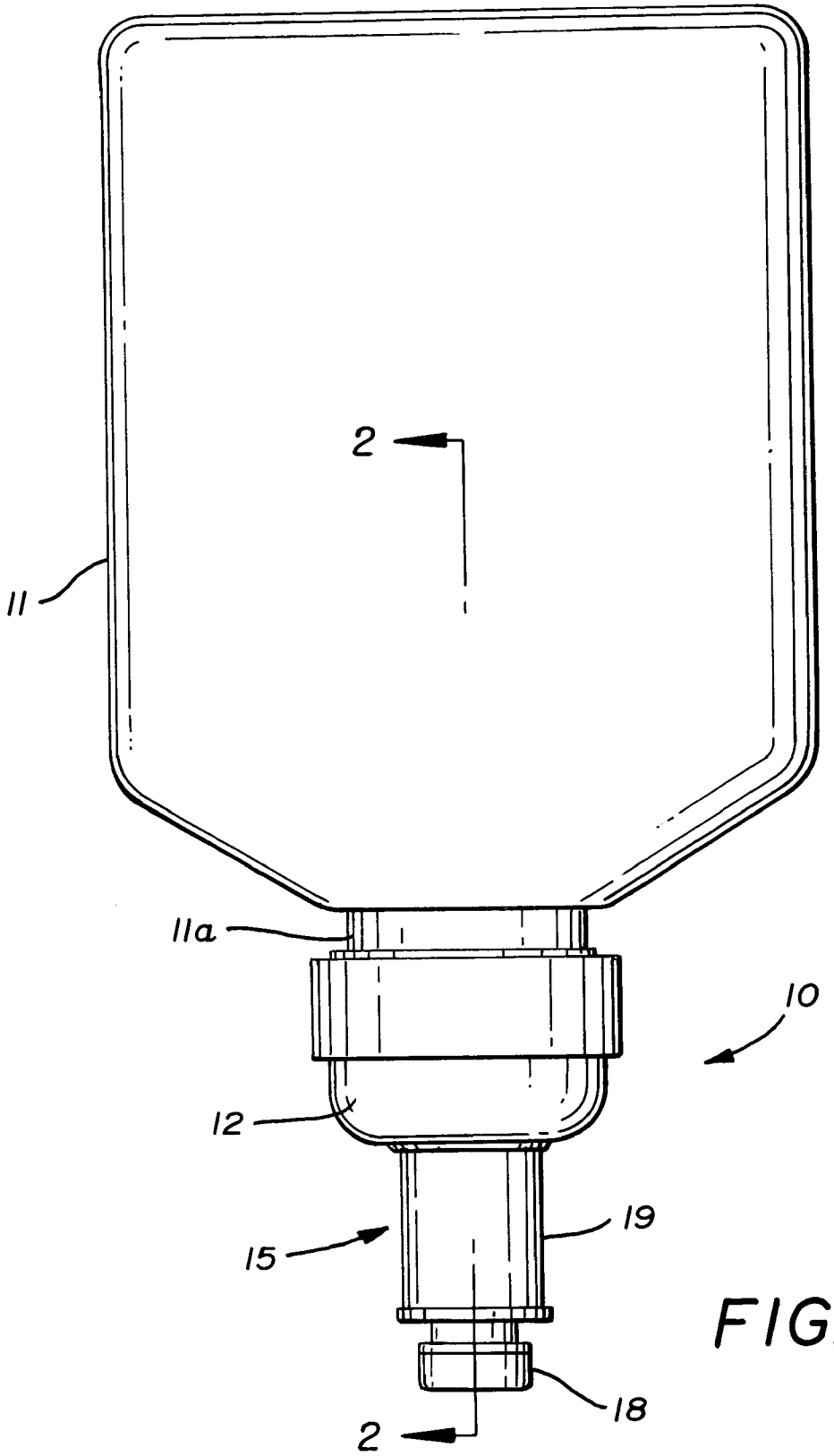
FIG. 1 is a perspective view of a container with the pump of the current invention attached to the end and shown in an inverted position.
Figure 2:
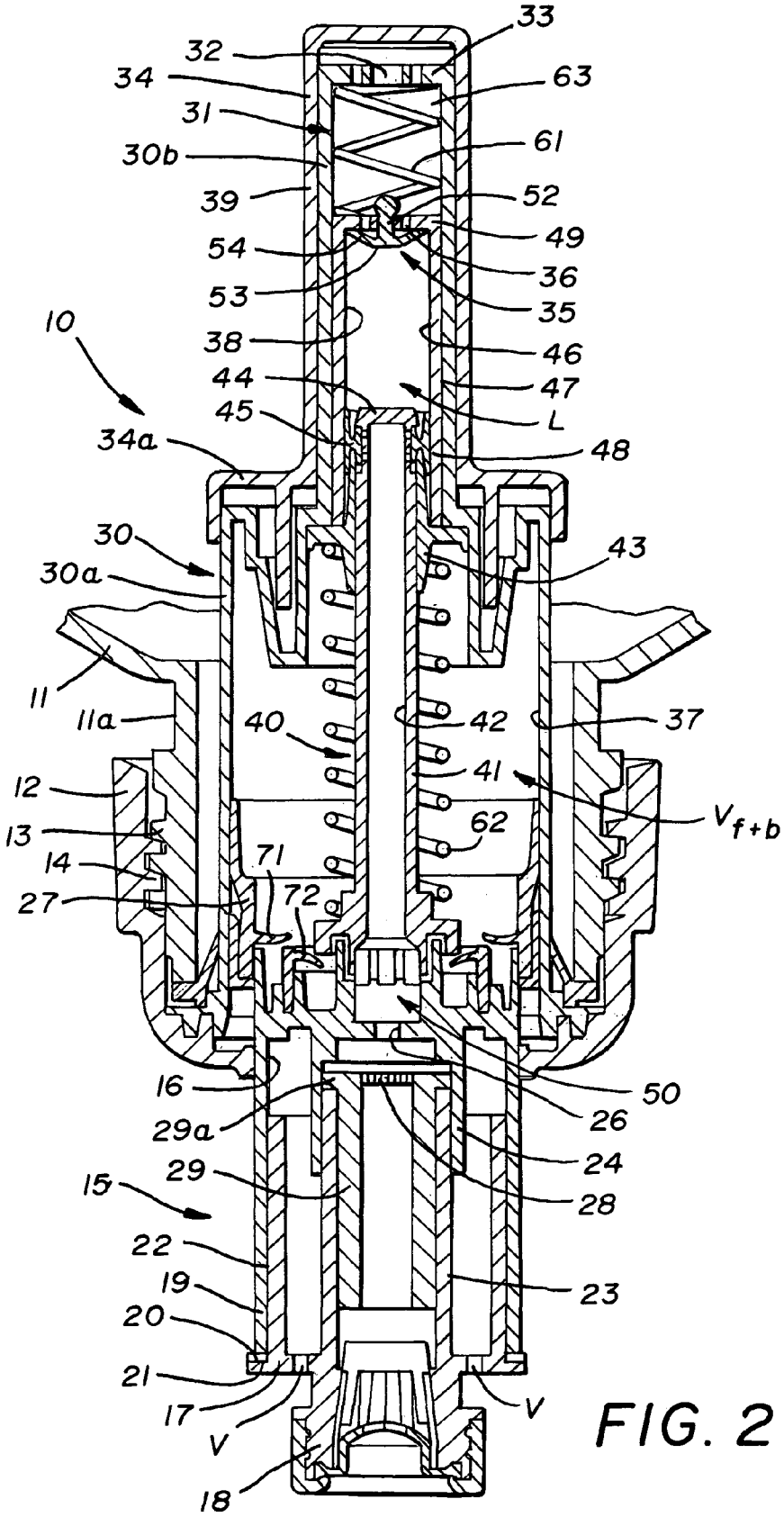
FIG. 2 is a sectional view of the improved pump in the fully extended position.

Referring first to FIG. 1 of the drawings, it will be seen that a pump, according to the concepts of the present invention and generally indicated by the numeral 10, is used in connection with a container 11. Container 11 may be of any type and a generic bottle-type container is shown for example purposes only. In the example, the container 11 and pump 10 are shown in a downward orientation, but the pump 10 is not limited to this orientation and may be inverted or otherwise displaced from the depicted orientation. In the example depicted in the figures, pump 10 is fastened to a neck portion 11*a* of container 11. A number of means of joining the pump 10 and container 11 may be used including, for example, threaded attachment of the pump 10 to the container 11, as shown in FIG. 2. To that end, a threaded collar 12 may be provided on pump 10 having internal threads 13 for attachment to external threads 14 formed on the neck portion 11*a* of container 11.

Pump 10 further includes a head assembly, generally indicated by the numeral 15, that extends axially outward through a bore 16 defined in the collar 12. The head assembly 15 is slidably received within bore 16 such that head assembly 15 may be depressed by the user to pump fluid from the container 11, as will be described more completely below. To facilitate its use head assembly 15 may be provided with one or more vents V that allow air to flow in and out of the head assembly 15 as it is attached.

As depicted in FIG. 2, the head assembly 15 may be formed in two pieces including an end cap 17 that carries a nozzle 18 through which fluid is expelled from the pump 10. End cap 17 may be fit within a generally cylindrical body portion 19 of head 15. As shown, the outward extremity of body portion 19 may be received within a recess 20 formed beneath a shoulder portion 21 of end cap 17, such that, the end cap 17 is held in abutment with the body portion 19. Further, the end cap 17 may include a cylindrical wall 22 received within the body portion 19 and closely fit thereto to provide an interference-type fit between the end cap 17 and body portion 19. In similar fashion, a nozzle tube 23 extending axially inward from the nozzle 18 may be fit within a concentric cylindrical tube receiver 24 that extends from a base 25 of the body portion 19. A passageway O may be formed in base 25 (FIG. 2B) to allow air to be drawn through the head assembly 15 into an air chamber 37, as described more completely below. Base 25 further defines a discharge orifice 26 that opens into nozzle tube 23 that provides communication between the nozzle 18 and a mixing chamber 50, described more completely below.

A screen 28 may be located beneath discharge orifice 26 to assist in the foaming process or help provide regular foam bubble size. The screen 28 may be supported in any manner including clips or shelves provided adjacent the orifice 26, or, as shown, the screen 28 may be trapped between a shoulder 27 formed in the base 25 and an annular flange 29*a* formed on a tubular insert 29. As shown, the insert 29 may, in turn, be held by contact of the nozzle tube 23 against the side of the annular flange 29*a* opposite the screen 28.

Figure 2A:
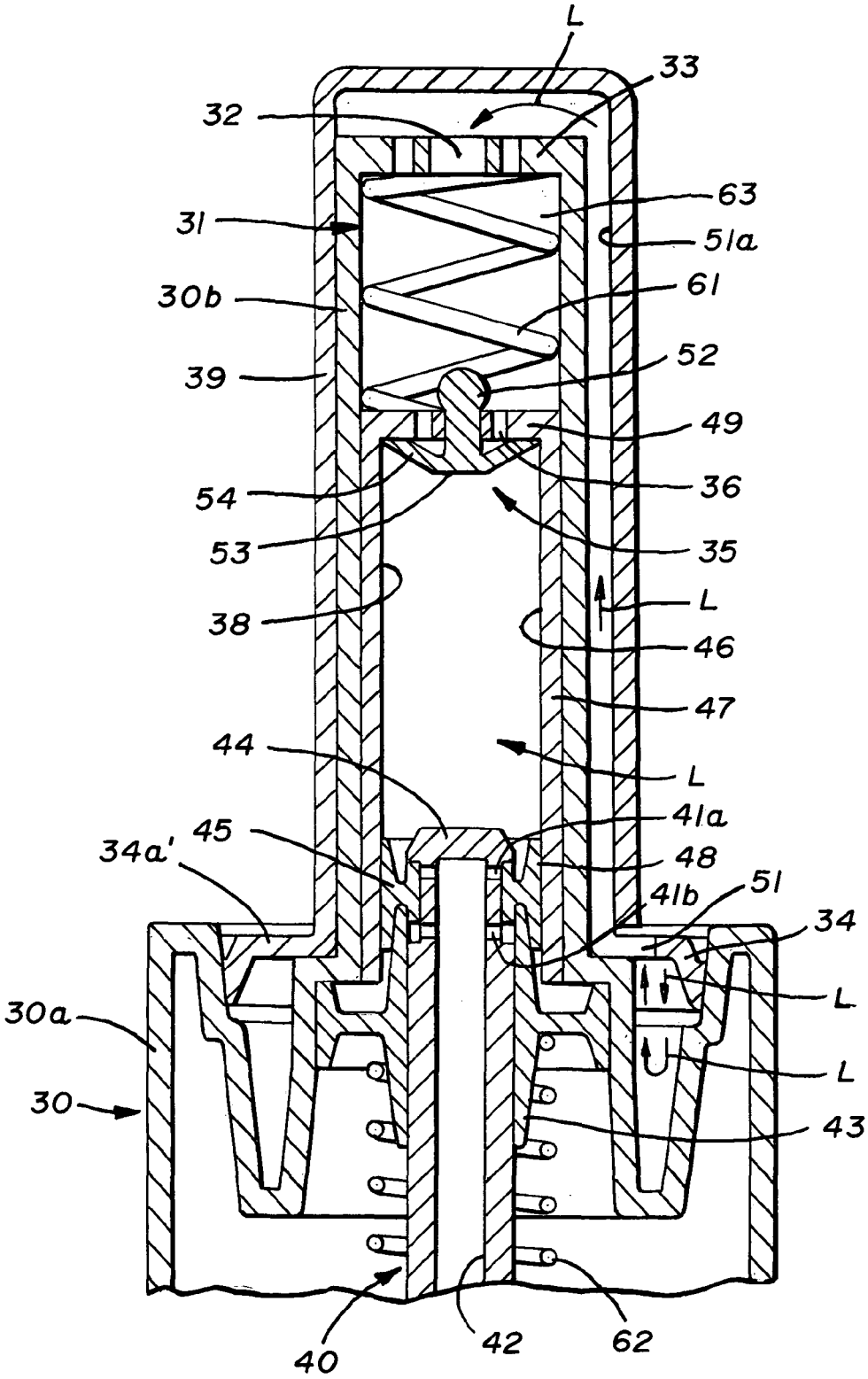
FIG. 2A is an enlarged partially fragmental sectional view of an upper half of an improved pump similar to the pump depicted in FIG. 2.
Figure 3:
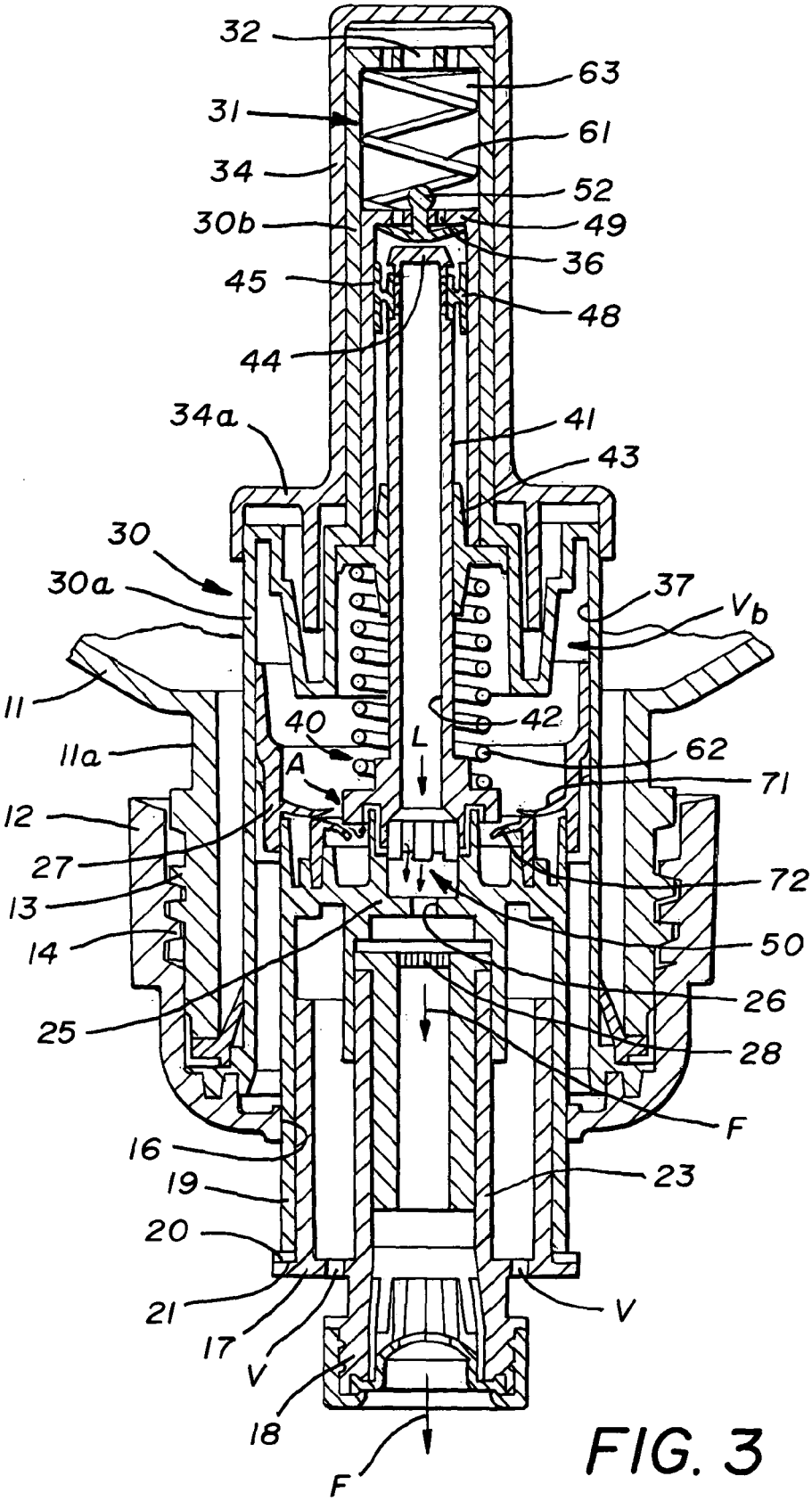
FIG. 3 is a sectional view similar to FIG. 1 showing the improved pump at the end of the liquid stroke.
Figure 4:
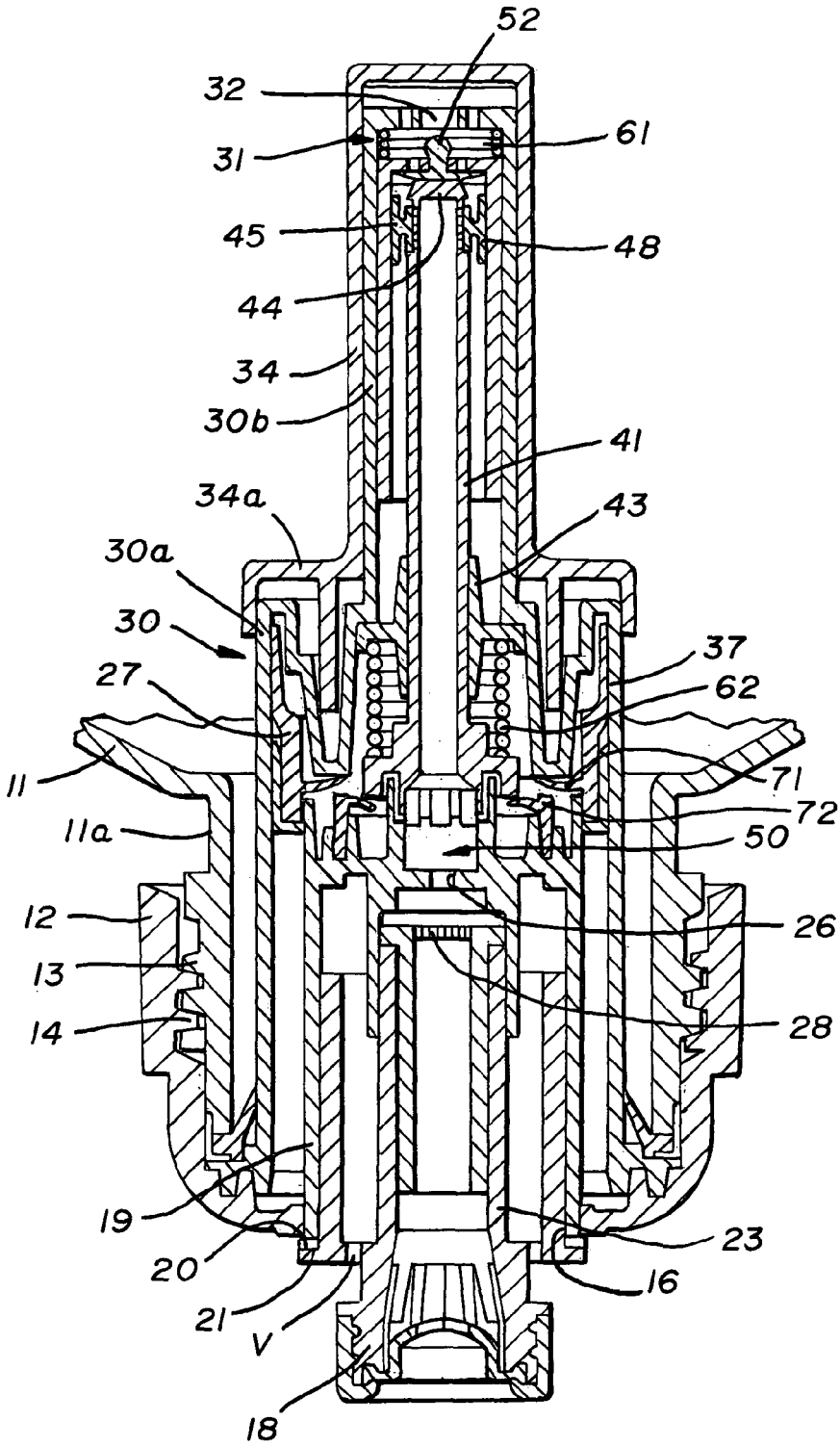
FIG. 4 is a sectional elevational view similar to FIG. 3 showing the improved pump in a fully compressed position showing the travel of the air pump an additional distance so as to provide a blast of air at the outlet.

As can be seen from FIGS. 2–4, head assembly 15 is slidably received within a pump body, generally indicated by the numeral 30, and may include a sealing flange 27 that sealingly engages the interior of pump body 30, as shown in FIG. 2. The sealing flange 27 may have any form including the skirt-like form shown. With the sealing flange 27 attached to head assembly 15, any leakage between the head assembly 15 and pump body 30 that might disturb proper function of the pump 10 is avoided. Pump body 30 is a generally cup-like member having an opening adapted to receive the head assembly 15 at its axial outward end and a liquid inlet 32 at its axial inward extremity. The inlet 32 may be carried on a wand-like inward portion 31 pump body 30 to facilitate its insertion into a container 11. As shown, the inward portion 31 of pump body 30 may be received within a pump seat 34. The shape of the pump seat 34 is arbitrary and any number of forms may be selected. For example, as shown in FIG. 2, pump seat 34 is shaped generally to conform to the contour of the pump body 30. In the example depicted in FIG. 2, the pump body 30 generally has a wider main body portion 30*a*, which defines the air chamber 37 and a narrow wand portion 30*b* that extends upwardly from the wide portion 30*a*. To that end, the seat 34 may include a radially extending shoulder 34*a* adapted to interconnection with the wide portion 30*a* of pump body 30. As shown in FIG. 2, the shoulder portion 34*a* may extend outwardly and around the periphery of the wide portion 30*b*. Alternatively, a shoulder 34*a* may be sized to nest within recess formed in the pump body 30, as shown for example in FIG. 2A. Pump seat 34 is open to the liquid L within container 11 allowing the liquid L to flow into the pump body 30 at liquid inlet 32.

To that end, one or more openings 51 may be formed in seat 34. The opening(s) 51 may be near the shoulder 34*a* of the seat 34 or otherwise in the lowest possible position within the container 11 such that the pump 10 is able to use the largest quantity of liquid L. The opening 51 may be located at higher locations with some loss in efficiency in terms of the amount of liquid L that may be used before having to replace or fill the container 11. In the example shown in FIG. 2A, the opening 51 is located at shoulder 34*a* and draws liquid L from the recess formed about the pump body 30. The liquid is drawn upwardly through a passage 51*a* formed adjacent the wand portion 30*b* and opens to the inlet 32 at the upper extremity of wand portion 305.

A check valve assembly, generally indicated by the numeral 35, is located at an opening 36 into a liquid chamber 38, which may be housed within pump body 30, to control the amount of liquid L entering the liquid chamber 38.

To provide for the production of a foam, pump body 30 defines an air chamber 37 and a liquid chamber 38 that communicate with mixing chamber 50, where liquid L and air from these chambers 37, 38 are combined. The air and liquid chambers 37, 38 are sealed from each other, as will be described more completely below, such that no mixing occurs at either of the air or liquid chambers 37, 38. Air chamber 37, when in the idle position shown in FIG. 2, defines a volume suitable for a foaming charge and blowing charge of air, generally indicated as $V_{f\&b}$. As will be described more completely below, the foaming charge is a volume of air suitable for mixing with the charge of liquid L held within liquid chamber 38, at idle, to form a foam-like substance for discharge through nozzle 18. The blowing charge $V_b$ is used to discharge any foam residue from the nozzle 18 at the end of a single pump stroke.

A plunger, generally indicated by the numeral 40, is seated on the head assembly 15 and movable therewith. As best shown in FIG. 2A, the plunger 40 may include a tubular shaft portion 41 that defines ports 41*a* and a bore 42 through which liquid L may be pumped from the liquid chamber 38 to the mixing chamber 50. The shaft 41 is slidably received within a seal 43 seated within the pump body 30 at the upper extremity of the air chamber 37. In this way, the shaft 41 and seal 43 close the air chamber 37 from the liquid chamber 38 located above the plunger assembly 40. The axial inward tip 44 of plunger 40 may carry a resilient collar 45 for sealingly engaging an inner surface 46 of a cup member 47 that is slidably received within pump body 30. To selectively provide fluid communication between the liquid chamber 38 and mixing chamber 50, the collar 45 may be slidably mounted on the shaft 41 to selectively cover ports 41*a* or 41*b*. In the idle position, shown in FIG. 2A, the abutment of collar 45 against seal 43 forces the collar upward against the axial inward tip of the plunger 40 such that it covers first portion 41*a*. In this way, fluid is prevented from draining from the liquid chamber 38 through the port 41*b*. As the plunger 40 is driven upward, the slidably mounted collar 45 is free to move downward opening port 41*a* to the bore 42. In this way, liquid L in the liquid chamber 38 is evacuated through the ports 41*a* and bore 42 and directed toward the mixing chamber 50. Once the liquid chamber 38 is evacuated, ports 41*b* prevent any pressure from forming behind the collar 45 that would prevent the plunger from returning to the idle position (FIG. 2). In this way, the plunger 40 is free to slide outward from the cup member 47 to allow refilling of the liquid chamber 38.

Cup member 47 has a cylindrical wall 48 that seats upon the seal 43, when in the idle position, shown in FIG. 2. At its axial inward extremity, cup member 47 has a base 49 that defines an opening 36 through which liquid L may pass. As described above, the entry of liquid L into the liquid chamber 38 defined by cup member 47 is controlled by a check valve 35. A conventional check valve may be used including the valve 35 shown. This valve 35 includes a stem 52 seated in the base 49 of cup member 47, as by a bulb 51, and a head portion 53 that extends radially outward from one end of the stem 52. The head 53 has a flexible flange 54 that may flex to control the flow of liquid into a liquid chamber 38. Alternatively, the valve 35 may move axially to open and close the opening 36.

In the embodiment shown in FIG. 2A, the liquid chamber 38 is full of liquid L such that the flap 54 is held in a closed configuration, where the flap covers the opening 36 that allows liquid to enter the liquid chamber 38. As the liquid is being forced from the liquid chamber 38, such as in the position shown in FIG. 4, the flap 54, under the influence of the negative pressure created by the downward stroke of the pump assembly, will flex downwardly creating a gap through which the liquid L may flow and fill the liquid chamber 38.

The cup member 47 extends to a lesser axial extent than the pump body 30 creating a gap at 61 between the base 49 of the cup member 47 and the end 33 of the pump body 30.

A first spring 61 is seated between the base 49 of cup member 47 and the end 33 of pump body 30. In this way, first spring 61 urges the cup member 47 toward engagement with the seal 43.

A second spring 62 is located between the seal 43 and head assembly 15 urging the head assembly 15 toward the fully extended or idle position shown in FIG. 2. In this position, the air chamber 37 contains a volume of air $V_{f\&b}$ that is sufficient to mix with the liquid L in liquid chamber 38 and create a selected amount of foam, referred to as a foaming charge, and a volume of air $V_b$ used to clear the nozzle 18 after the foam is dispensed. This latter volume $V_b$ will be referred to as a blowing charge $V_b$.

To control the flow of air A, first and second valves 71, 72 are located on the head assembly 15 and may be supported on base 25 adjacent mixing chamber 50. The valves 71, 72 may be of any type and may be conventional form. Advantageously, valves 71, 72 may be check valves limiting the intake of air through first valve 71 and avoiding any contamination that might occur by drawing supply air through the nozzle 18 and second valve 72. To further avoid the intake of air through the mixing chamber 50, second valve 72 may be oriented to limit the flow of air A toward mixing chamber 50, as shown. In the embodiment depicted in the drawings, valve 71, 72 generally comprise flexible flaps that are responsive to changes in pressure to effect selective opening and closing of the valve 71, 72. For example, first valve 71 may be used to control the in take of air into the air chamber 37. In the idle position, shown in FIG. 2, first valve 71 is open allowing air to fill air chamber 37. When the user urges the head assembly 15 inward, as shown in FIG. 3, the air pressure within air chamber 37 forces the first valve 71 to flex axially outward and contact second valve 72 sealing the air chamber 37 from further in take of air. The same pressure causes the second valve 72 to flex outward away from a wall of the mixing chamber 50 allowing air A to pass through the second valve 72 and into the mixing chamber 50 by way of a passageway 73, best shown in FIG. 2B. To distribute the incoming air, and help prevent the liquid from entering passageway 73, a manifold, generally indicated by the numeral 75, having a centrally located opening (not shown) corresponding to the bore 42 of the plunger 40 through which the liquid L enters the mixing chamber 50 and a crenelated outer surface 74 having a plurality of circumferentially spaced notches is provided to allow the air A to enter from the periphery of the mixing chamber 50, as schematically shown by the arrows in FIG. 3.

Figure 2B:
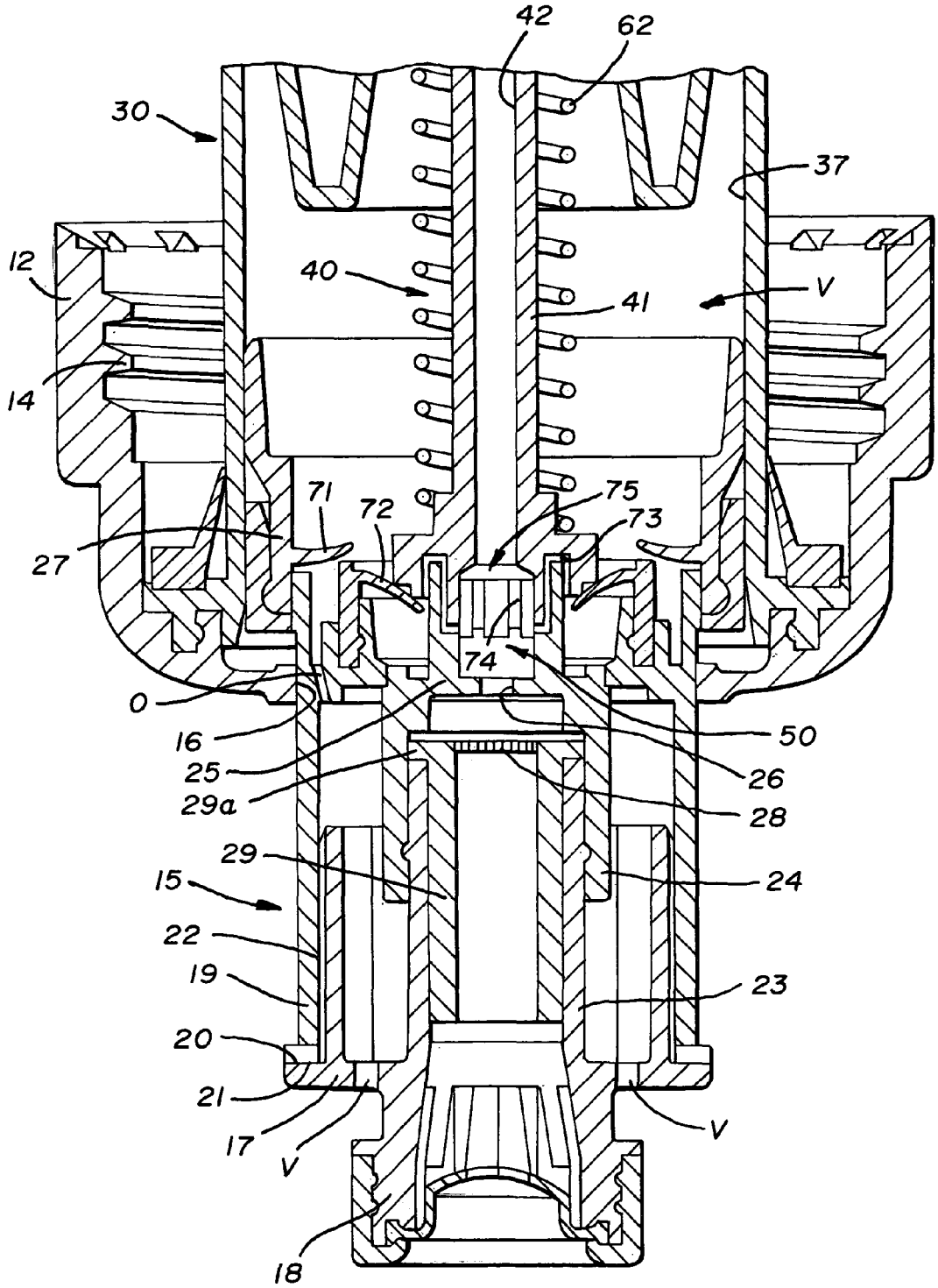
FIG. 2B is an enlarged partially fragmental sectional view of the lower half of a pump similar to the pump depicted in FIG. 2.

Once the air is evacuated from the air chamber 37, as shown in FIG. 4, the return of the head assembly 15 to the idle position forms a vacuum within the air chamber 37 that draws the first valve 71 open, as is shown in exaggerated form in FIG. 4, to allow the air chamber 37 to be refilled. To refill air chamber 37, air may be drawn through vents V formed in the head assembly. To avoid any contamination of the incoming air, these vents V may be separated from the flow path of the foam F. Referring to FIG. 2B supply air may be drawn through vents V and a passageway O formed in the base 25 of head assembly 15, which may be located in line with the first valve 71 with first valve 71 open, air from vents V is free to flow into air chamber 37.

With reference to FIG. 3, in operating the pump 10, the head assembly 15 is driven axially inward, by the user, compressing the second spring 62. As the head assembly 15 moves inward, the plunger 40 is driven into the liquid chamber 38 forcing the liquid L into the mixing chamber 50. In the position shown in FIG. 3, the plunger 40 has bottomed out within the cup member 47 evacuating the liquid chamber 38 of all liquid L. This portion of the pump stroke causes the head assembly 15 to compress the air A within air chamber 37 driving the foaming charge of air A into the mixing chamber 50 with liquid L to form a foam F that is then discharged from the pump 10 at nozzle 18. The volume of air remaining in air chamber 37 after the liquid chamber 38 is emptied (FIG. 3), forms blowing charge $V_b$.

As best shown in FIG. 4, as the pump stroke continues, the head assembly 15 is driven further inward such that the blowing charge $V_b$ is forced out through the nozzle 18 clearing any foam residue that remained in the mixing chamber 50 and/or nozzle 18. To provide for the dispensing of the blowing charge $V_b$ without further disbursement of liquid L or foam, the plunger 40 is permitted to move upwardly even after it has bottomed out with the cup member 47. A clearance 63 (FIG. 3) located above the cup member 47 defined by the pump body 30 permits further travel of the plunger 40. Further, the cup member 47 is slidably mounted within the pump body 30, such that, when the plunger 40 bottoms out within the cup member 47, the continued upward movement of the plunger 40 causes the cup member 47 to travel with the plunger 40. As discussed previously, a first spring 61 may be provided in the clearance 63 to urge the cup member toward seal 43. The upward action of the plunger and cup member 47 during the blowing phase of the stroke (FIG. 4) compresses the first spring 61. Once the user releases the pump head 15, first spring 61 may return the cup assembly 47 toward the idle position shown in FIG. 2. In essence, cup member 47 is a movable liquid chamber 38 that permits extension of the pump stroke to drive air through the nozzle 18 after all of the liquid L has been discharged. In this way any dripping associated with such residue is avoided.

In the position shown in FIG. 4, both springs 61, 62 are compressed causing the head assembly 15 to stop indicating to the user that the pump stroke is complete. Upon release of the head assembly 15, the first and second springs 61, 62 respectively urge the cup member 47 and head assembly 15 toward the idle position. As will be appreciated, this outward movement of the cup member 47 creates a vacuum that opens check valve assembly 35 allowing liquid L to fill the liquid chamber 38.

Simultaneously, air is drawn into the air chamber 37 through first valve 71 readying the pump 10 for another dispensing stroke.

To allow the first spring 61 to maintain its form until the completion of the discharge of foam, first spring 61 may have a greater compression strength than the second spring 62. In this way, while some compression of second spring 61 may occur, as can be seen from a comparison of FIG. 2 and FIG. 3, the greater compression strength of first spring 61 allows it to maintain its extended position in the face of any pressure created within the liquid chamber 38 by plunger assembly 40 until the plunger assembly 40 drives the cup member 47 upwardly against the spring 61 in the blowing portion of the stroke, depicted in FIG. 4. It will be appreciated that the pump 10 is equally operable without the use of a first spring 61 having a greater compressive strength than the second spring 62. In general, any spring arrangement may be used.

To summarize use and operation of the pump 10, the pump 10 may be inserted into a liquid filled container 11 and attached thereto as by a collar 12, where a head assembly 15 slidably mounted within the pump body 30 extends beyond the collar 12 for actuation by the user. As the user forces the head assembly inward, a plunger 40 and the head assembly 15 simultaneously force liquid and air from respective liquid and air chambers 38, 37 into a mixing chamber 50, where the two fluids mix to form a foam. The foam F subsequently flows from the mixing chamber 50 and may pass through a screen 28 located between the mixing chamber 50 and a nozzle 18 to provide a selected bubble size. After passing the screen 28, the foam F is discharged at the nozzle 18. To clear the foam containing passageways, after the plunger 40 has bottomed out within the liquid chamber 38, a clearance 63 provided between the pump body and the cup 47, within which the liquid L is held, allows the head assembly 15 to continue to travel inward discharging an additional volume of air $V_b$ that blows any foam F clinging to the surfaces of the passageways between the mixing chamber 50 and the nozzle 18. In this way, foam residue that may return to liquid form and drip from the nozzle 18, as is common in prior art pumps is largely if not completely removed reducing the likelihood of dripping related to foam residue.

While a full and complete description of the invention has been set forth in accordance with the dictates of the patent statutes, it should be understood that modifications can be resorted to without departing from the spirit hereof or the scope of the appended claims.

What is claimed is:

1. A pump used in connection with a container filled with a liquid, the pump comprising:

a) a pump body defining an air chamber and a liquid chamber separated by a seal;

b) a cup slidably received within said pump body at said liquid chamber, said cup being in selective communication with the liquid, whereby said cup is filled with liquid when the pump is in an idle position;

c) a head assembly slidably mounted within said pump body and sealingly engaging said air chamber;

d) a plunger extending from said head assembly through said seal and into said cup and slidably received therein; and e) a mixing chamber in selective fluid communication with said liquid chamber and said air chamber, said mixing chamber opening externally of said head assembly, whereby operation of the pump causes liquid from the liquid chamber and air from the air chamber to mix in the mixing chamber to form a foam which is discharged from the head assembly;

f) wherein said cup is spaced from an end of said pump body by a first spring adapted to urge said cup toward said plunger;

g) wherein said plunger is adapted to bottom out in said cup to empty said liquid chamber; wherein said air chamber is sized to allow further inward movement of said head assembly after said plunger bottoms out, whereby said further inward movement of said head assembly compresses said spring and forces a blowing charge from said air chamber through said mixing chamber and said head assembly to evacuate any foam remaining therein.

2. The pump of claim 1, wherein said cup has a base, said base being spaced from said end of said pump body and wherein said spring is located between said end and said base.

3. The pump of claim 1, wherein said cup includes a valve adapted to selectively allow liquid from the container to fill said liquid chamber.

4. The pump of claim 3, wherein said cup includes a base defining an opening in communication with the liquid; wherein said valve is seated in said base and axially slidable relative thereto, said valve including a stem portion and a head portion extending radially outward thereto to cover said opening.

5. The pump of claim 4, wherein said head portion of said valve includes a flexible flange adapted to flex outwardly from said base in said cup when a negative pressure is formed within said cup by said plunger.

6. The pump of claim 1, wherein said plunger includes a hollow shaft extending outwardly from said mixing chamber and a sleeve mounted on said shaft, wherein said sleeve slidably engages an inner surface of said cup, wherein said shaft defines a port opening outward from said bore; wherein said sleeve is positioned over said port and slidable on said shaft to expose said port to said fluid as said plunger is driven into said liquid chamber, whereby liquid from said liquid chamber travels through said port and said bore toward said mixing chamber.

7. The pump of claim 1 further comprising a screen mounted downstream of said mixing chamber whereby the foam exiting said mixing chamber passes through said screen.

8. The pump of claim 1, wherein selective fluid communication between the air chamber and the mixing chamber is controlled by a first valve and a second valve, said first valve being in communication with said air chamber and a vent opening externally of the pump, said second valve being in fluid communication with said air chamber and said mixing chamber, wherein said first and second valves are flexible, wherein inward movement of said head assembly pressurizes said air chamber flexing said first valve to a closed position and said second valve to an open position allowing air from said air chamber to be directed to said mixing chamber and whereby a negative pressure within said air chamber causes said first valve to flex open allowing air from outside of the pump to enter said air chamber.

9. The pump of claim 1 further comprising a second spring operatively engaging said pump body and said head assembly, whereby said second spring urges said head assembly outward from said pump body.

10. The pump of claim 9, wherein said first spring has a greater compression strength than said second spring.

11. A pump used in connection with a container filled with a liquid, the pump comprising: a pump body defining an air chamber; a cup housed within and moveable relative to said pump body, said cup defining a liquid chamber, said cup being in selective fluid communication with the container; a head assembly movable relative to the pump body and adapted to mix air from said air chamber and liquid from said liquid chamber, said mixture being dischargeable through a nozzle during a portion of a single pump stroke; a spring biasing said liquid chamber toward said head, such that movement of said head during said pump stroke evacuates said liquid chamber before evacuating all of the air in said air chamber, whereby compression of said spring during the remainder of said pump stroke discharges air from said air chamber through said nozzle.

* * * * *